US008281876B2

(12) United States Patent
Heieie et al.

(10) Patent No.: US 8,281,876 B2
(45) Date of Patent: Oct. 9, 2012

(54) REAMERS AND METHODS FOR DIRECTIONAL DRILLING

(75) Inventors: John M. Heieie, Maricopa, AZ (US); Steven L. Ugrich, Bovey, MN (US)

(73) Assignee: Southeast Directional Drilling, LLC, Casa Grande, AZ (US)

( * ) Notice: Subject to any disclaimer, the term of this patent is extended or adjusted under 35 U.S.C. 154(b) by 271 days.

(21) Appl. No.: 12/788,654

(22) Filed: May 27, 2010

(65) Prior Publication Data

US 2010/0263936 A1 Oct. 21, 2010

Related U.S. Application Data

(63) Continuation-in-part of application No. 12/767,085, filed on Apr. 26, 2010, now Pat. No. 7,958,950, which is a continuation of application No. 12/187,521, filed on Aug. 7, 2008, now Pat. No. 7,730,969.

(60) Provisional application No. 61/076,298, filed on Jun. 27, 2008.

(51) Int. Cl.
*E21B 7/28* (2006.01)
*E21B 10/26* (2006.01)

(52) U.S. Cl. ..... 175/53; 175/344; 175/406

(58) Field of Classification Search ..... 175/53, 175/344, 345, 346, 406
See application file for complete search history.

(56) References Cited

U.S. PATENT DOCUMENTS

| | | | | |
|---|---|---|---|---|
| 5,090,492 | A | 2/1992 | Keith | |
| 5,224,540 | A | 7/1993 | Streich et al. | |
| 5,314,267 | A | 5/1994 | Osadchuk | |
| 5,485,888 | A | 1/1996 | England | |
| 5,979,573 | A | 11/1999 | Osadchuk | |
| 5,979,574 | A | 11/1999 | Osadchuk | |
| 6,227,311 | B1 | 5/2001 | Osadchuk | |
| 7,958,950 | B2 * | 6/2011 | Osadchuk et al. | 175/53 |

OTHER PUBLICATIONS

Office Action dated Oct. 27, 2009 for U.S. Appl. No. 12/187,521.

* cited by examiner

*Primary Examiner* — Giovanna Wright
(74) *Attorney, Agent, or Firm* — Honigman Miller Schwartz and Cohn LLP

(57) ABSTRACT

A reamer includes a mandrel defining a mandrel axis and arms extending radially from the mandrel. Each arm has a proximal end and a distal end. The reamer includes a cutting head disposed on the distal end of each arm and cutting teeth disposed on each cutting head. The cutting heads are arcuately spaced about the central mandrel to allow the movement of debris axially along the central mandrel and at least one of the arms defines a square cross-sectional shape.

18 Claims, 11 Drawing Sheets

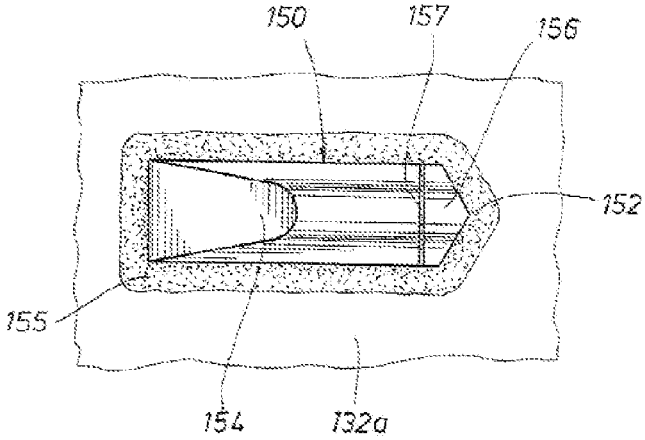
FIG. 13
FIG. 11
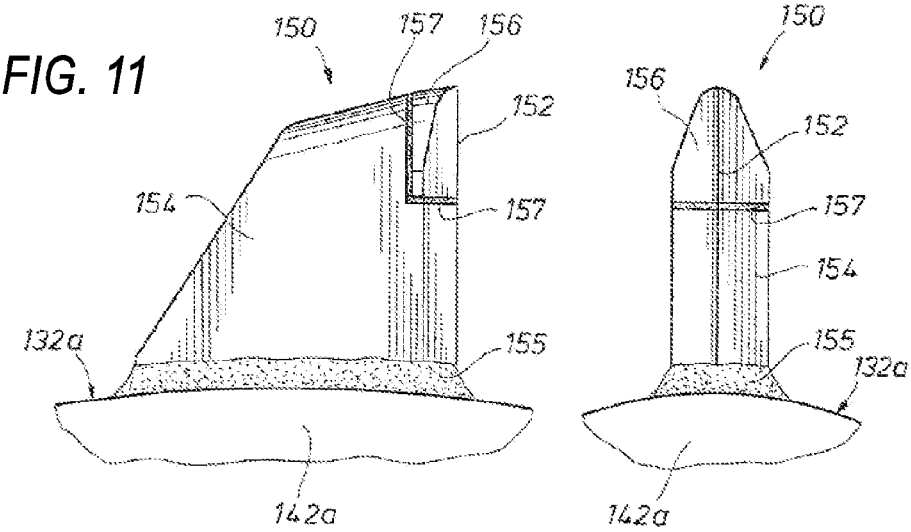
FIG. 12

REAMERS AND METHODS FOR DIRECTIONAL DRILLING

CROSS REFERENCE TO RELATED APPLICATIONS

This U.S. patent application is a continuation-in-part of, and claims priority under 35 U.S.C. §120 from, U.S. patent application Ser. No. 12/767,085, filed on Apr. 26, 2010, which is a continuation of U.S. patent application Ser. No. 12/187,521, filed on Aug. 7, 2008, which claims priority under 35 U.S.C. §119(e) to U.S. Provisional Application 61/076,298, filed on Jun. 27, 2008. The disclosures of these prior applications are considered part of the disclosure of this application and are hereby incorporated by reference in their entireties.

TECHNICAL FIELD

This disclosure relates to reamers for enlarging pilot bores formed during horizontal drilling operations.

BACKGROUND

In general, a pipeline can be installed with a horizontal drilling apparatus under a barrier, such as highway, road, waterway, building, or other surface obstruction without disturbing the barrier. Installation of the pipeline under the barrier typically entails forming a pilot bore under the barrier and then enlarging the pilot bore with a boring head, also known as a reamer or a hole opener. A pipeline section can be advanced behind the boring head and drilling liquids can be supplied to the boring operation through the pilot bore.

SUMMARY

One aspect of the disclosure provides a reamer for underground boring. The reamer includes a mandrel defining a mandrel axis and arms extending radially from the mandrel. Each arm has a proximal end and a distal end. The reamer includes a cutting head disposed on the distal end of each arm and cutting teeth disposed on each cutting head. The cutting heads are arcuately spaced about the central mandrel to allow the movement of debris axially along the central mandrel and at least one of the arms defines a square cross-sectional shape.

Implementations of the disclosure may include one or more of the following features. In some implementations, the at least one arm having a square cross-sectional shape defines a longitudinal axis coincident with a radial axis of the mandrel. Opposite corners of the substantially square cross-sectional arm shape may be arranged in a line substantially parallel to the mandrel axis. For example, the at least one arm may define first and second diagonal cross-sectional axes. Each diagonal cross-sectional axes is perpendicular to the other and intersects respective opposite diagonal corners of the square cross-section defined the at least one square cross-sectional shaped arm. The first diagonal cross-sectional axis can be arranged substantially parallel to the mandrel axis. Arranging the square cross-sectional shaped arm with the diagonal cross-sectional axis substantially parallel to the mandrel axis provides relatively greater arm strength against bending moments of the arm about the mandrel during drilling operations as compared to arranging the square cross-sectional shaped arm with a defined transverse axis (at a 45 degree angle to the diagonal axes) parallel to the mandrel axis.

In some implementations, the reamer includes at least one gusset between each arm and the mandrel. The gussets provide the arms with relative greater strength to sustain bending moments of the arms about the mandrel during drilling operations, as compared to arms without gussets.

Each arm may define a passageway along a length of the arm. The arm passageway can be in fluid communication with a mandrel passageway defined by the mandrel and optionally a head passageway defined by the respective cutting head. In some examples, the mandrel has first and second axial ends, where at least one of the axial ends is adapted for connection to a drill pipe. Drilling fluid delivered through drilling pipe attached to the mandrel can be received through the passageways for ejection to the reamer location (e.g., for cooling and/or lubrication). In some examples, the mandrel passageway is in fluid communication with an arm passageway defined by at least one of the arms and at least one port defined by the corresponding cutting head of the at least one arm for receiving a flow of drilling fluid therethrough. The at least one port can be arranged to deliver a flow of drilling fluid substantially in a direction of drilling and/or substantially in a direction of rotation around the mandrel axis.

In some implementations, the reamer includes wear bars disposed on each cutting head. The wear bars may each define a half-circular cross-shape. A collection of wear bars may be disposed along a radial distal portion of each cutting head. Moreover, in some examples, cutting teeth are disposed on opposite sides of the collection of wear bars along the radial distal portion of each cutting head.

A surface of at least one cutting head may define an arcuate section of a torus. The cutting teeth of the at least one cutting head can be disposed on the surface defining an arcuate section of a torus. Moreover, in some examples, wear bars are disposed on the at least one cutting head and/or the cutting teeth each have at least one cutting edge arranged to face a direction of rotation around the mandrel axis.

In some examples, the intersection of the cutting heads with the respective distal ends of the tubular arms defines a shoulder overhanging the central mandrel.

One aspect of the disclosure provides a reamer for underground boring includes at least: (a) a center mandrel, wherein the center mandrel defines a mandrel axis; (b) a plurality of arms extending radially from the center mandrel; (c) a plurality of cutting heads, wherein each of the cutting heads: (i) is supported by at least one of the arms; (ii) is arcuately spaced-apart around the center mandrel from the other cutting heads; (iii) has a rounded surface; and (d) a plurality of cutting teeth on the rounded surface of each of the cutting heads.

Anther aspect of the disclosure provides a method of drilling that includes opening a pit or trench on each side of a barrier or area to be traversed underground. The method includes forming a pilot bore between the two trenches and enlarging the diameter of the pilot bore with a reamer. The method may include using multiple reamers having different sizes to stepwise increase the diameter of the pilot bore. The pilot bore may increase in size to accommodate installation of a pipeline through the reamed bore.

The details of one or more implementations of the disclosure are set forth in the accompanying drawings and the description below. Other aspects, features, and advantages will be apparent from the description and drawings, and from the claims.

DESCRIPTION OF DRAWINGS

FIG. 11 is a side view of an exemplary cutting tooth of a reamer.

FIG. 12 is a front view of the cutting tooth shown in FIG. 11 looking toward the cutting edge of the cutting tooth.

FIG. 13 is a top view of the cutting tooth shown in FIG. 11 looking at the cutting tooth as it may be positioned on a portion of a rounded surface of a cutting head of a reamer.

Like reference symbols in the various drawings indicate like elements.

DETAILED DESCRIPTION

Figure 1:
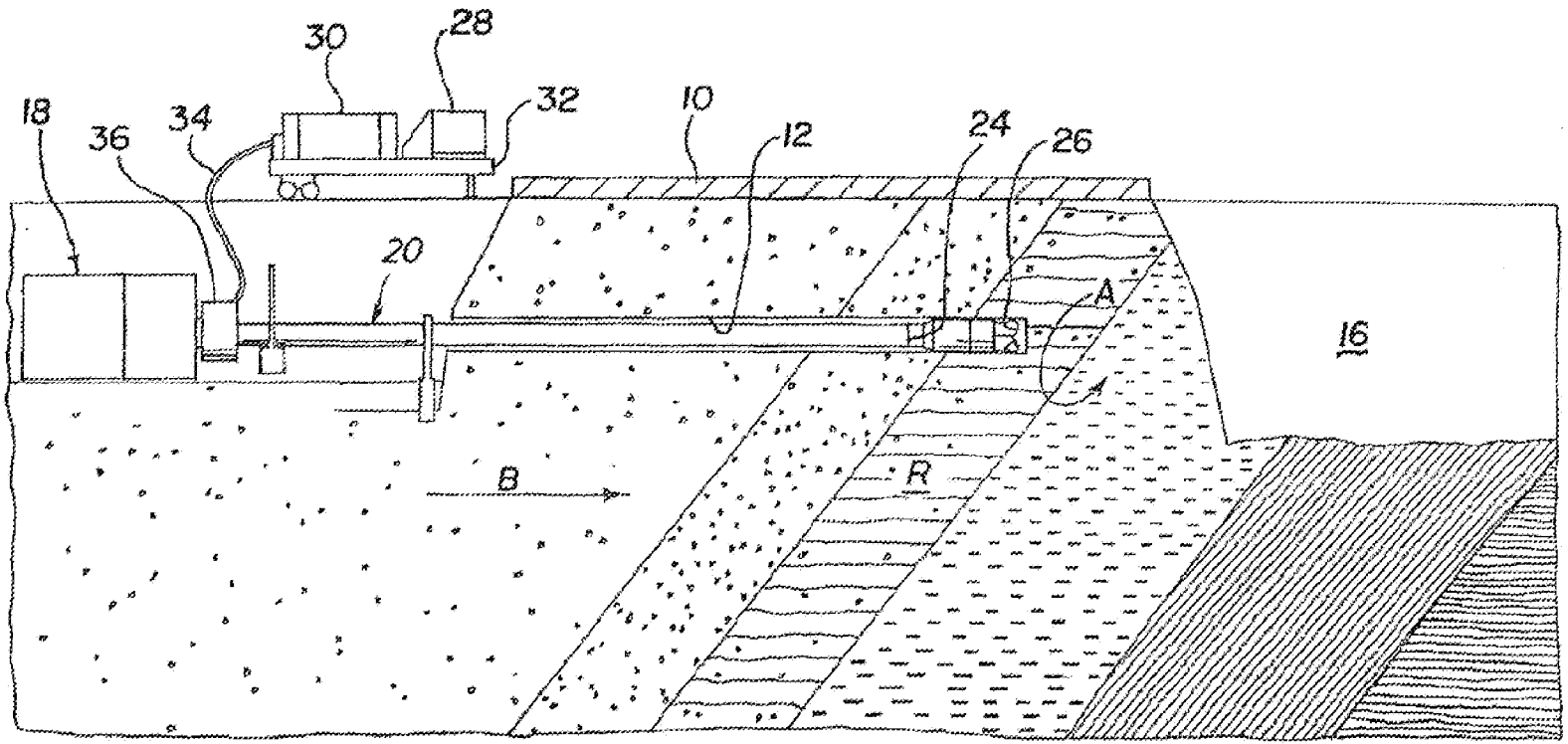
FIG. 1 is a schematic view illustrating drilling a pilot bore for installing a larger diameter section of pipe under a barrier, such as a roadway.

A horizontal drilling method and apparatus may be used to install a pipeline under the barrier, such as highway, road, waterway, building, or other surface obstruction without disturbing the barrier. In some implementations, installing a pipeline under a barrier includes forming a pit or trench on either side of the barrier, placing a drilling or boring apparatus on one side of the barrier, and boring a passageway under the barrier between the two open trenches. The passageway, or bore, is of sufficient size to allow one or more sections of pipe to be pushed or pulled lengthwise through the bore from one side of the barrier to the other. The installed section can be welded into the pipeline and tested.

Directional drilling or horizontal boring may include drilling a pilot hole under the barrier (e.g., between the two open trenches) as a beginning of the directional drill crossing. The pilot hole can be achieved by excavation by fluid jetting or by a down-hole motor and drill. Depending on the condition of the soil, the pilot bore is formed along a pre-determined alignment in which the path is selected by conventional methods. The typical pilot hole on most large rigs is 9⅞", but can vary depending on the soil conditions and rig size. A drill head attached to the end of the drill pipe drills or cores the pilot hole. Drilling fluid is pumped through the drill pipe to a drill head and jetted through or pumped through a drill motor. The drill fluid lubricates the drill stem and carries out cut debris to the surface (e.g., one of the trenches). The drill fluid is then recycled and re-injected into the drill stem. Forming the pilot hole can take several days, depending on the condition of the soil and may require changing of the drill pipe or drill head.

Once formed, the pilot hole is enlarged with a reaming process. The reaming process employs a reamer, which is sometimes referred to as a hole opener. Reamers come in different shapes and sizes and vary depending on the soil conditions and density of the soil; typically, a fly cutter is used in good ground conditions. The reaming pass(es) can be done in several steps, depending on the size of the hole. For example, a 42" diameter finish hole may require 3 to 5 different ream passes of 14", 20", 34", and 42" diameters. The reaming process includes attaching a reamer to the drill string (e.g., drill pipe) and rotating and pushing and/or pulling the reamer through the pilot bore. The reaming process may including pumping a drill fluid (e.g., water or slurry) through the drill pipe to the reamer. The excavated soil is suspended in the drill fluid and then brought to the surface and recycled. In some examples, when the reamer is attached to the drill string, a drill pipe extends on both sides of the reamer, thus allowing for the drill string to be in the hole at all times. The reaming process can take a significant amount of time depending on the condition of the soil.

After a desired hole size has been achieved and the reamer has passed through the hole completely, a mud pass or packer reamer may be passed through the reamed hole. The mud pass or packer reamer assures that the hole is clean of all excavated material and that the drill fluid has filled the hole completely, to allow for a smooth lubricated pull back of the pipe, avoiding friction of a pull section.

After the reaming process, a pipe can be pulled into the reamed hole. The process may include installing a weld cap on the pipe where a swivel is placed attaching the drill string, thus, not allowing any rotation of the pipeline. Depending on the size of the pipe, an artificial buoyancy measure might be taken to keep the pipeline close to neutral buoyancy. If no buoyancy measures are taken, several problems may occur (e.g., coating damage from the pipe floating in the drill fluid and causing excess friction resulting in pull resistance). In some examples, buoyancy control includes pumping water into the pipeline through a pipe and checking the gallons pumped. At completion of the direction drilling, demobilization and clean-up takes place.

When rock or other hard materials are encountered in the drilling operation, problems can arise which cause the installation to be difficult and expensive. For example, when installing a large-diameter pipeline, such as a 36" or 40" pipeline under an interstate highway that may be 300 feet wide, massive forces can be present during the horizontal drilling process. The large forces can result from encountering hard materials along the drill path, making it difficult, if not impossible, to form the bore in a straight path. When rock or other hard materials are encountered, a reamer or hole opener can tend to corkscrew, bend, and deviate from a straight path. A non-linear drill path can make installation of straight pipe difficult or impractical. However, under a wide barrier, such as a wide river, it is possible to install the pipeline along a gently curved path under the barrier. In some cases, the pipe will become stuck during the process of insertion into the bore and the stuck pipe must be cut off, the old bore filled up and abandoned, and a new bore formed in the attempt to install the section of pipeline under the barrier. These and other difficulties in boring through barriers of rock or other hard materials cause the horizontal drilling process to be difficult and expensive.

The need for improvements is particularly long-felt in horizontal drilling for installing large-diameter pipeline sections. The larger the diameter of the desired bore, the greater the twisting force that is created in the drilling operation. Torque is the product of a force and the perpendicular distance from the line of action of the force to the axis of rotation. The hardness of the rock, the advancing force on the boring head, and all else being equal, for any given radial distance from the axis of the boring operation, the resulting torque is a product of that radial distance. Thus, the larger the boring head, the greater the perpendicular distance from the line of action of the force to the axis of rotation. A torque is created at every point along the radial cutting swath of the boring operation, such that the integral summation of these torques increases the width of the cutting swath of the boring operation.

For example, in opening up a 9-inch pilot bore to 30 inches in a single drilling operation, the cutting swath is about radial 21 inches wide. Thus, a 30-inch diameter boring head working against hard rock in the 21-inch wide cutting swath toward the periphery of the boring head creates a substantial twisting force (torque) about the axis of the pilot bore. If attempting to open up a 9-inch pilot bore to 60 inches in a single drilling operation, the cutting swath would be about 51 inches wide, and the tremendously increased torques involved would usually make such a drilling operation impractical. Thus, it is usually not possible to enlarge the initial pilot bore to a very large diameter bore in a single drilling operation.

To install a 60-inch pipeline, for example, the relatively small pilot bore must usually be opened up to at least one intermediate diameter. If very hard rock is encountered, it may be necessary to use several stepwise drilling operations to open up the pilot bore to successively-larger-and-larger diameter bores until the desired diameter is achieved. For example, the pilot bore may be first enlarged to 24 inches, then, in a second drilling operation, be enlarged to about 42 inches, and finally in a third drilling operation, enlarged to 60 inches.

Despite enlarging the pilot bore in stepwise drilling operations, in opening up a 42-inch bore to 60 inches, for example, the 60-inch diameter boring head working against hard rock in the 18-inch cutting swath toward the periphery of the boring head creates tremendous twisting force about the axis of the pilot bore. Even if the guide in the pilot bore helps maintain the drilling operation in a substantially straight line, the tremendous twisting force may cause the drilling operation to drill eccentrically of the central axis of the pilot bore. With each successive drilling operation to increase the bore size, the off-center drilling creates an increasingly misshapen bore, which tends to become increasingly triangular and can be loosely described as "A" shaped. The misshapen bore may require that a substantially larger bore be formed to install the desired large pipeline, which costs time and money.

Furthermore, the twisting forces created in the drilling operation can be so large that the boring head becomes increasingly likely to completely twist off its drive shaft, also referred to as a drill pipe. If the boring head twists off the drill pipe, retrieving the boring head can be very time consuming and expensive, and the boring operation may have to be abandoned in favor of a new attempt.

FIG. 1 illustrates drilling a pilot bore 12 under a barrier 10, such as a roadway. A first trench 14 is opened on one side of the barrier 10. A second trench 16 is opened on the opposite side of the barrier 10 along the intended path for a pipeline (not shown). The first and second trenches 14 and 16 are dug to the appropriate depth for placement of a pipeline section under the barrier 10.

Once the first and second trenches 14 and 16 are opened, a horizontal drilling rig 18 can be used to drill the pilot bore 12. The drilling rig 18 includes a powered rotator (not shown) for rotating a drill pipe 20 carrying a drill bit or drill head 26. The drilling rig 18 may be mounted on or includes an advancer for horizontally advancing the drilling operation. For example, the drilling rig 18 can be mounted on tracks that allow the entire drilling rig 18 to move horizontally and advance the drilling operation.

Drilling the pilot bore 12 can be accomplished by rotating and horizontally advancing the drill pipe 20 and the attached drill bit 26. The drill pipe 20 can be any suitable drive shaft for transferring rotational motion from the drilling rig 18 to the drill bit 26. For example, as shown in FIG. 1, a forward or distal end of the drill pipe 20 has a pipe connector 24 (e.g., a threaded connector) for receiving and connecting the drill bit 26 to the drill pipe 20. The drilling rig 18 rotates and horizontally advances the drill pipe 20 and attached drill bit under the barrier 10 to drill or form the pilot bore 12 from the first trench 14 to the second trench 16 beneath the barrier 10. The pilot bore 12 can be formed by proceeding in either direction from one side of the barrier 10 to the other.

While drilling the pilot bore 12, a drilling fluid, such as water or muddy water, can be supplied through the drill pipe 20 and drill bit 26. Other types of drilling fluid may be used as well, besides water. In some implementations, a drilling fluid pump 28, in fluid communication with a tank 30 holding the drilling fluid, delivers the drilling fluid to the drill pipe 20. The pump 28 and the tank 30 can be moved on a trailer 32. In some examples, the pump 28 is operatively connected through a suitable flexible tubing 34 to a rotatable coupling 36 on the drill pipe 20. The drill pipe 20 has an axial passageway for receiving the drilling fluid therethrough. The pump 28 pumps drilling fluid from the tank 30, through the flexible tubing 34, the rotatable coupling 36, and into the drill pipe 20. The drill pipe 20 may spin within a sliding seal in the coupling 36 while the drilling fluid is pumped into and through drill pipe 20 to the drill bit 26. One or more small ports (not shown) formed at the forward end of the drill pipe 20 or in the drill bit 26 deliver the drilling fluid to the exterior of the drill bit 26. The flowing drilling fluid cools the drill bit 26 and aids in lubricating the cutting of the earth and rock to form the pilot bore 12.

The diameter of the pilot bore 12 can be relatively small compared to the diameter of the pipeline section that is to be installed under the barrier 10. For example, a pilot bore 12 can be 8¾ inches in diameter. The particular size of the pilot bore is not critical, but it is important that the drill bit 26 be sized so that a sufficiently stiff drill pipe 20 can be utilized to cut through any rock, such as a rock strata R, encountered under the barrier 10 while maintaining a straight pilot bore 12. The relatively small diameter of the drill bit 26 results in relatively small twisting forces during the drilling operation, making it relatively easier to form a straight pilot bore 12 beneath the barrier 10.

When connected to the drill pipe 20, the drill bit 26 rotates with the drill pipe 20. The direction of rotation A of the drill bit 26 may clockwise or counterclockwise. However, when using a threaded pipe connector 24, the direction of rotation should not unscrew the connection.

The drill pipe 20 and drill bit 26 can be selectively moved or advanced in a forward direction B and/or a reverse direction while drilling the pilot bore 12. While forming the pilot bore 12, the drill bit 26 can be carefully advanced horizontally in the forward direction B to advance from the first trench 14 toward the second trench 16. Upon reaching the second trench 16, the pilot bore 12 is completed, and the drill bit 26 is removed from the drill pipe 20.

Figure 2:
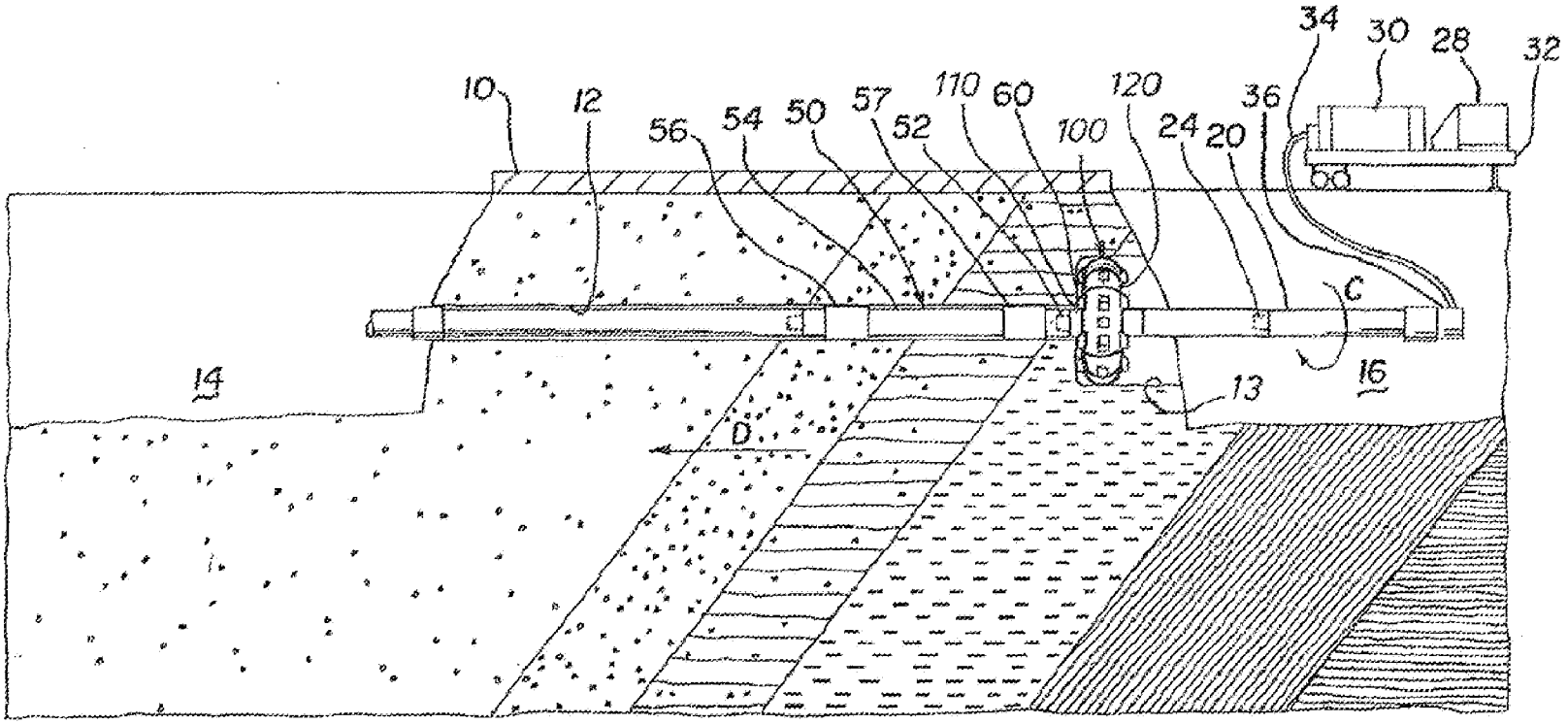
FIG. 2 is a schematic view illustrating enlarging a pilot bore for installing a larger diameter section of pipe under a barrier, such as a roadway.

FIG. 2 illustrates enlarging the pilot bore 12 to an enlarged bore 13 having a larger diameter than the pilot bore 12. The drill pipe 20 is operatively connected to a drilling rig (not shown in FIG. 2) positioned in the second trench 16, similar to the situation previously described with respect to FIG. 1. Similarly, the drilling fluid pump 28, tank 30, and flexible tubing 34 can be operatively connected to a rotatable coupling 36 as previously described with respect to FIG. 1. Referring to FIG. 2, in some implementations, a reamer 100 is coupled to the drill pipe 20 extending through the pilot bore 12. The drilling rig 18 rotates, pushes and/or pulls the drill pipe 20 and attached reamer 100 through the pilot bore 12 to enlarge the size of the pilot bore 12. In some examples, pipe connectors 24, 52 (e.g., threaded male or pin connectors) couple the reamer 100 to the drill pipe 20.

Referring to FIG. 2, in some implementations, the reamer 100 includes an axial or center mandrel 110, which may be similar in size to the drill pipe 20 and have a flow conduit therethrough for receiving the drilling fluid to the reamer 100. The mandrel 110 defines a mandrel axis 111 and may connect the reamer 100 to the drill pipe 20 (e.g., at the threaded pipe connector 24 in a co-axial manner).

A guide assembly 50 may connect to the string of drill pipe 20 (e.g., via a threaded pipe connector 52) at a forward end of the mandrel 110 of the attached reamer 100. In the example shown in FIG. 2, the guide assembly 50 includes a tubular member 54 with a cylindrical wear plate 56 and a cylindrical guide 57 mounted thereon. The cylindrical guide 57 is positioned in advance of or forward of the reamer 100 in the string of drill pipe 20 and is selected to be of a size to fit in and be guided by the walls of the pilot bore 12. The guide 57 may also act as a dam or seal on the walls of the pilot bore 12 to prevent drilling fluid supplied to the reamer 100 from flowing forward through the pilot bore 12. The guide 57 may also be positioned axially to the front or advancing side of the reamer 100 by a sufficient distance so that straight guiding forces apply sufficient torque to the reamer 100 in a proper orientation. In the example shown, the guide 57 is positioned forward of the reamer 100 by a distance of at least about the diameter of the pipeline section to be installed.

Enlarging the pilot bore 12 to the enlarged bore 13 can be accomplished by rotating and horizontally advancing the drill pipe 20 with the reamer 100 connected thereto. The reamer 100 may enlarge the pilot bore 12 from the second trench 16 to the first trench 14 beneath the barrier 10, vice versa, or in both directions. While advancing the reamer 100, the guide assembly 50 steers the reamer 100 along the path of the pilot bore 12. Since the reamer 100 is attached at both ends to a drill pipe 20 extending between the first and second trenches 14, 16, a drilling rig 18 may be used from either side of the barrier 10 to push and/or pull the reamer 100 through the pilot bore 12.

During the drilling operation, the drill pipe 20 and the reamer 100 receive drilling fluid from the drilling fluid pump 28 in fluid communication with the tank 30. The drilling fluid pump 28 pumps drilling fluid from the tank 30, through the flexible tubing 34 (or any suitable conduit), the rotatable coupling 36, and into the drill pipe 20. One or more small ports that formed in the reamer 100 deliver the drilling fluid to the region of the cutting. The flowing drilling fluid cools the reamer 100 and aids in lubricating the cutting of the earth and rock to enlarge the pilot bore 12 to the desired enlarged bore 13. During a reaming pass, the pilot bore 12 can be used to supply fluids to the reamer 100 while the enlarged bore 13 behind the reamer 100 can be used for removing the cut debris or cuttings. As the enlarged bore 13 is being drilled, it remains substantially filled with drilling fluid and cuttings.

The drilling rig 18 rotates the coupled drill pipe 20 in direction of rotation C. While the direction of rotation, whether clockwise or counterclockwise, is not critical to the drilling operation, when using a threaded connection, the direction of rotation should not unscrew the connection. When connected to the drill pipe 20, the reamer 100 rotates with the drill pipe 20 and enlarge the pilot bore 12.

The drill pipe 20 and reamer 100 can be selectively moved or advanced in the forward and reverse direction of a drilling direction D. During the drilling operation, the reamer 100 is carefully advanced horizontally in the drilling direction D to advance from one trench 14, 16 to another (e.g., from the second trench 16 toward the first trench 14). Upon reaching the opposite trench 14, 16 (e.g., the first trench 14), the enlarged bore 13 is completed, and the reamer 100 is removed from the drill pipe 20. More than one reaming pass may be used to enlarge the pilot bore 12 to the desired diameter for the enlarged bore 13. A reaming pass can be made from either the first trench 14 to the second trench 16 or vice versa.

After reaming to obtain an enlarged bore 13 from one side of the barrier 10 to the other, the enlarged bore 13 remains substantially filled with drilling fluid and cuttings. A pipeline section is floated into the enlarged bore 13. Once the one or more pipeline sections are in position to span the barrier 10, the drilling fluid is pumped out of the section(s), and the pipeline section can be tested for integrity against leaks.

Figure 3:
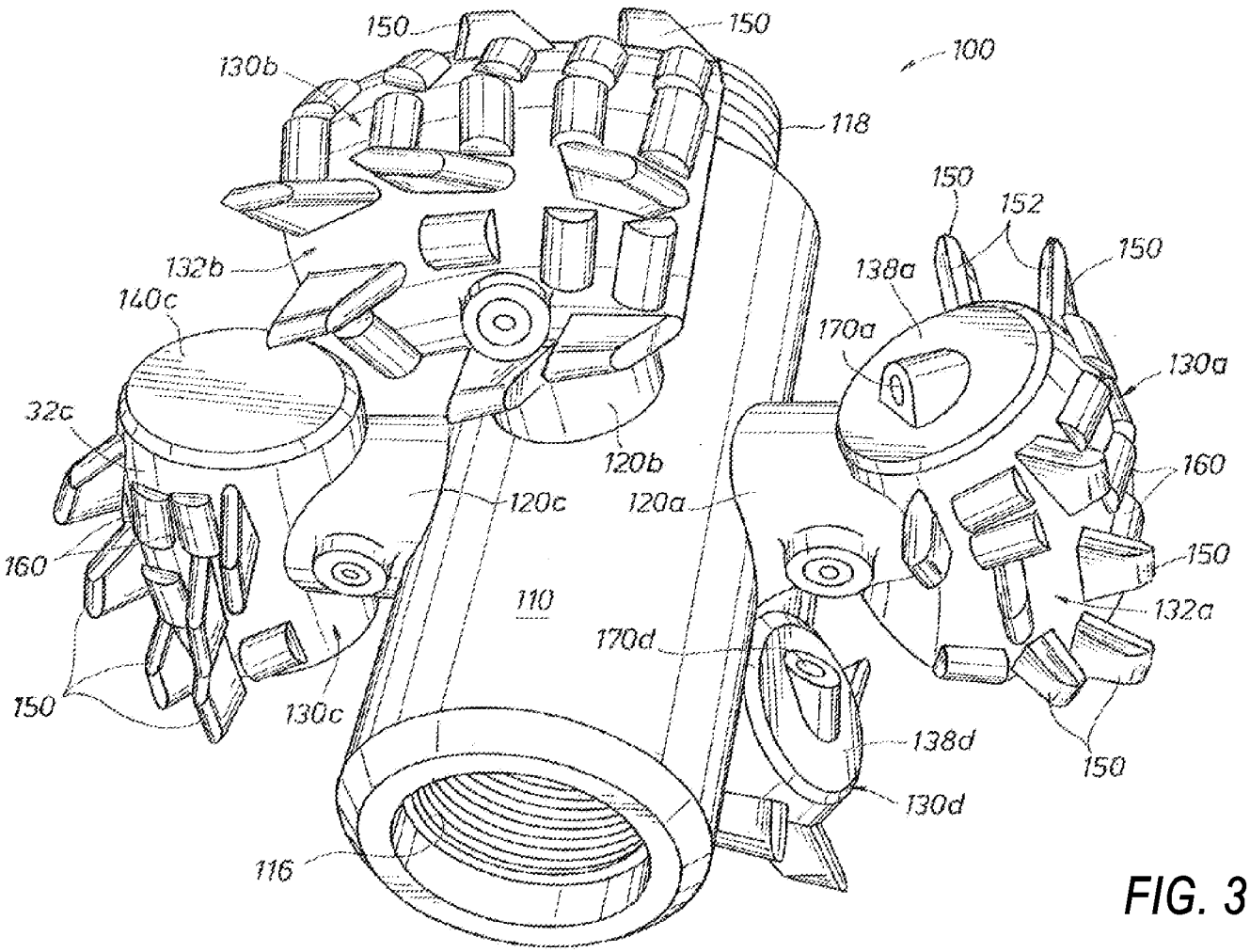
FIG. 3 is a perspective view of an exemplary reamer.
Figure 4:
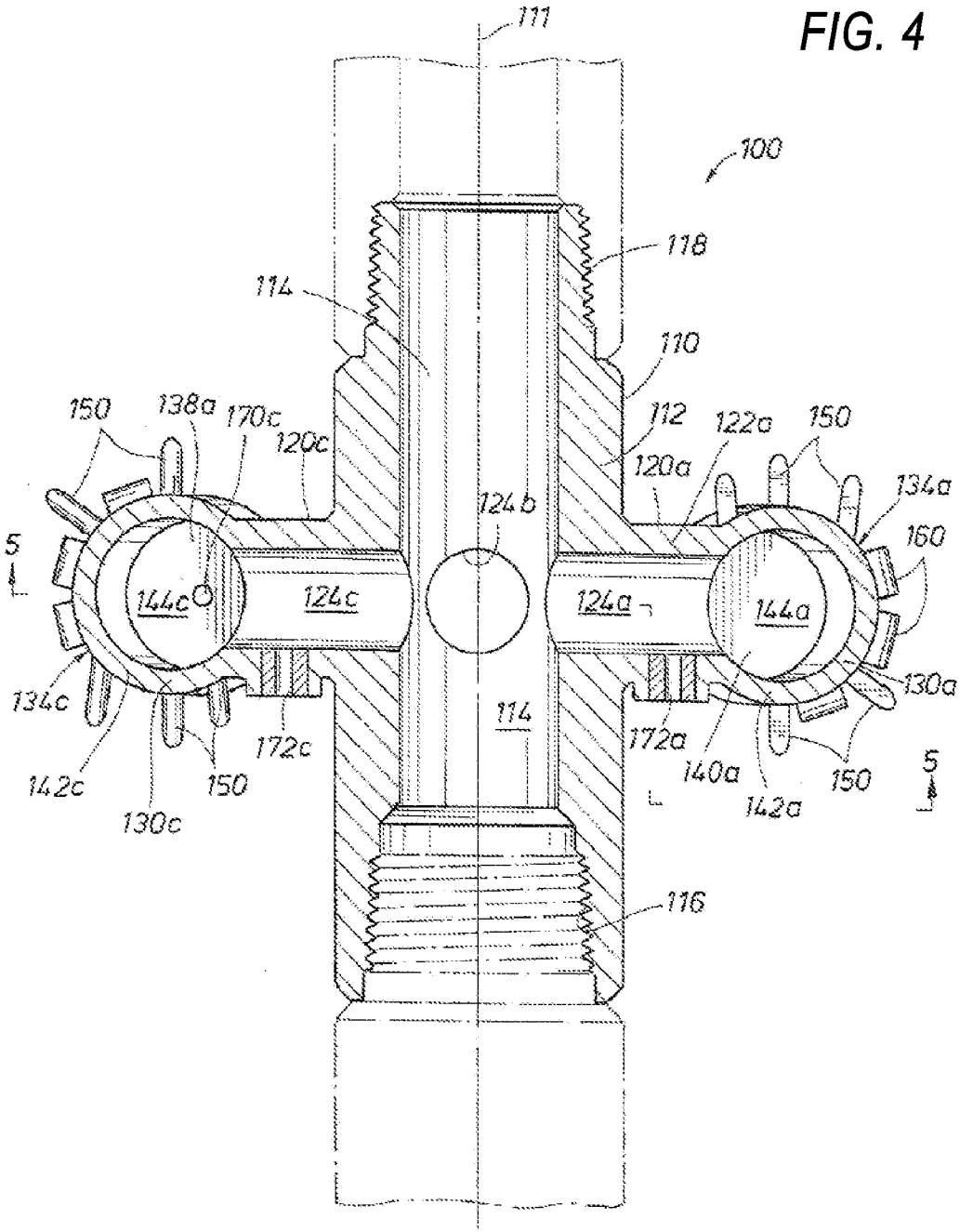
FIG. 4 is a cross-sectional view taken through a plane containing the mandrel axis and the center of two opposed arms and cutting heads of the reamer shown in FIG. 3.
Figure 5:
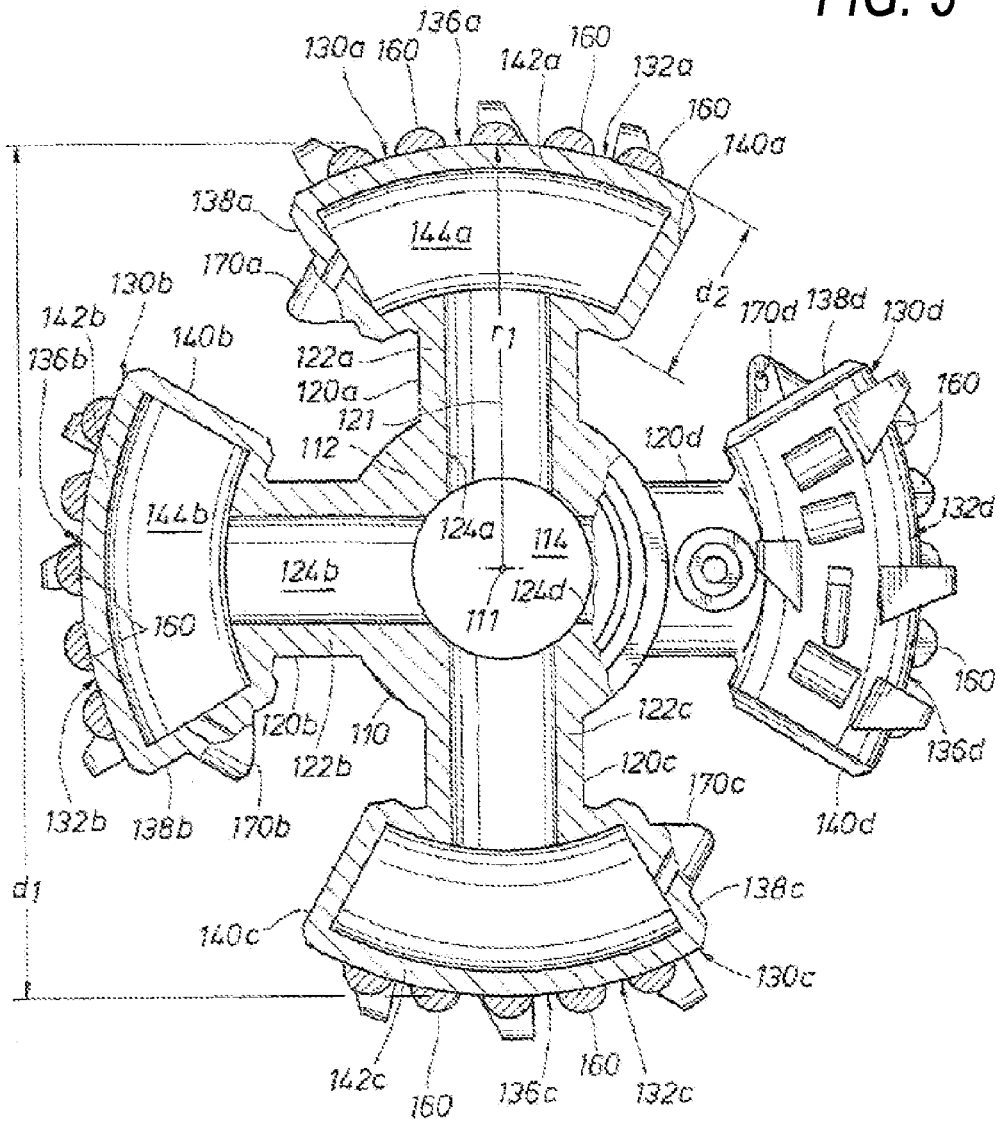
FIG. 5 is a partial cross-sectional view taken along lines 5-5 of the view of the reamer shown in FIG. 4.
Figure 6:
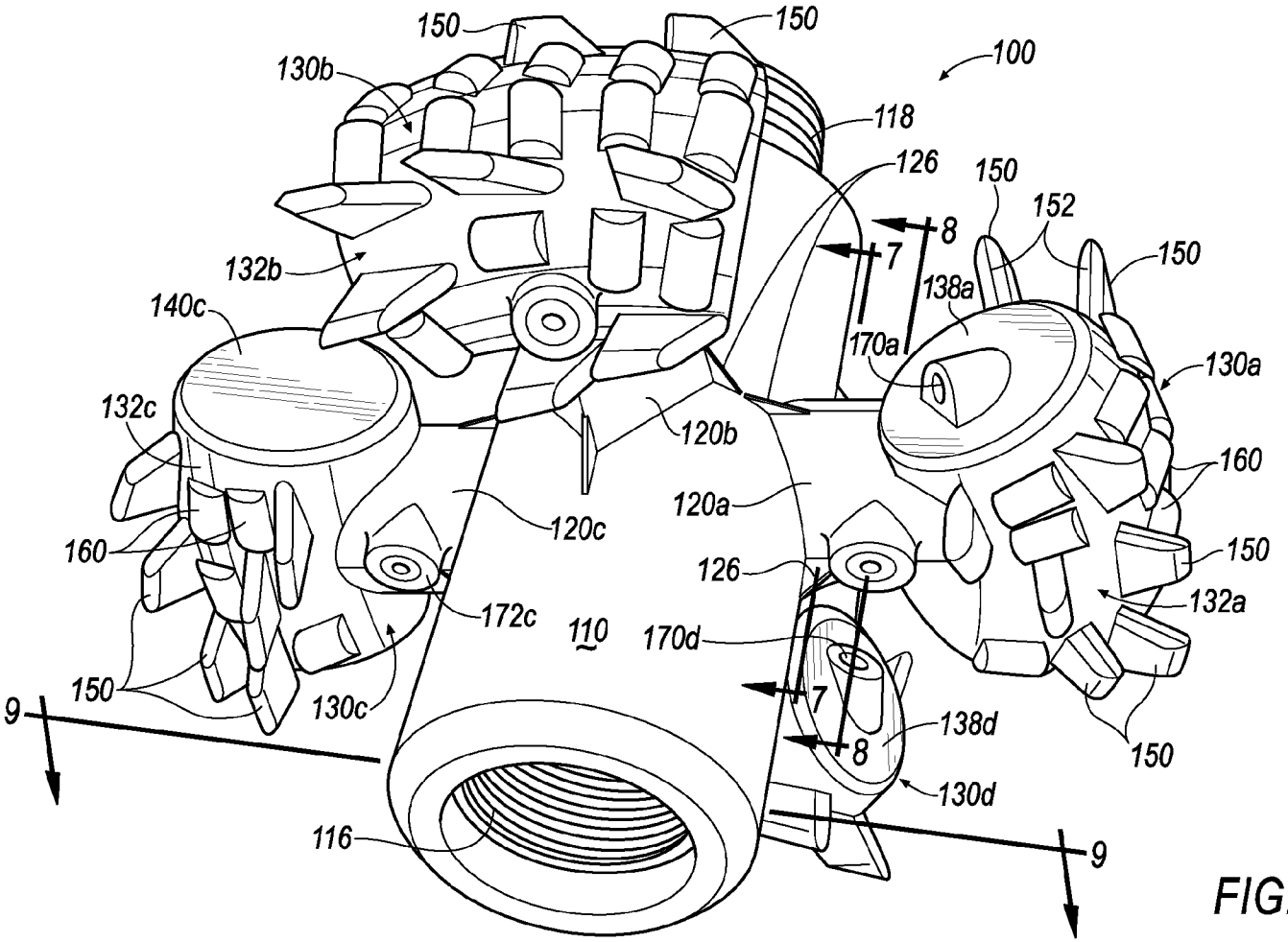
FIG. 6 is a perspective view of an exemplary reamer.

Referring to FIGS. 3-5, in some implementations, the reamer 100 includes a mandrel 110 defining a mandrel axis 111. Arms 120*a-d* extend radially form the mandrel 110. Each arm 120*a-d* has proximal end attached to the mandrel 110 and distal end. In some examples, the cutting heads 130*a-d* are arcuately spaced about the central mandrel 110 to allow the movement of debris axially along the central mandrel 110. A cutting head 130*a-d* is disposed on the distal end of each arm 120*a-d*. Cutting teeth 150 disposed on each cutting head 130*a-d* to cut through the rock and soil located below the barrier 10. In some examples, each cutting head 130*a-d* has a rounded surface 132*a-d*, respectively, supporting the corresponding cutting teeth 150.

Referring now to FIGS. 4-5, in some implementations, the mandrel 110 has a tubular body 112 (e.g., circular, square, polygonal, etc. in cross-sectional shape) defining a mandrel passageway 114 (e.g., for receiving drilling fluid from the drill pipe 20). A female threaded connector 116 is formed or disposed at one axial end of the mandrel 110, and a male threaded connector 118 is formed or disposed at the other axial end.

In some examples, the arms 120*a-d* disposed around the mandrel 110 extend outwardly from the center mandrel along radial axes 121*a-d* in a plane perpendicular to the mandrel axis 111. In other examples, the arms 120*a-d* are disposed in multiple planes perpendicular to the mandrel axis 111 (e.g., staggered along the mandrel axis 111). Each arm 120*a-d* may have a tubular body 122*a-d* defining an arm passageway 124*a-d* in fluid communication with the mandrel passageway 114 (e.g., for receiving drilling fluid). In the examples shown in FIGS. 4-5, the arms 120*a-d* each have a tubular body 122*a-d* that defines a circular cross-section; however other cross-sectional shapes are possible, such as square, polygonal, etc. For example, referring to FIGS. 6-10, the arms 120*a-d* have tubular bodies 122*a-d* that each define a substantially square cross-sectional shape. The square tubular arm bodies 122*a-d* each define a transverse axis 123 perpendicular to a longitudinal axis 125, which is coincident with the respective radial axis 121*a-d*.

Figure 7:
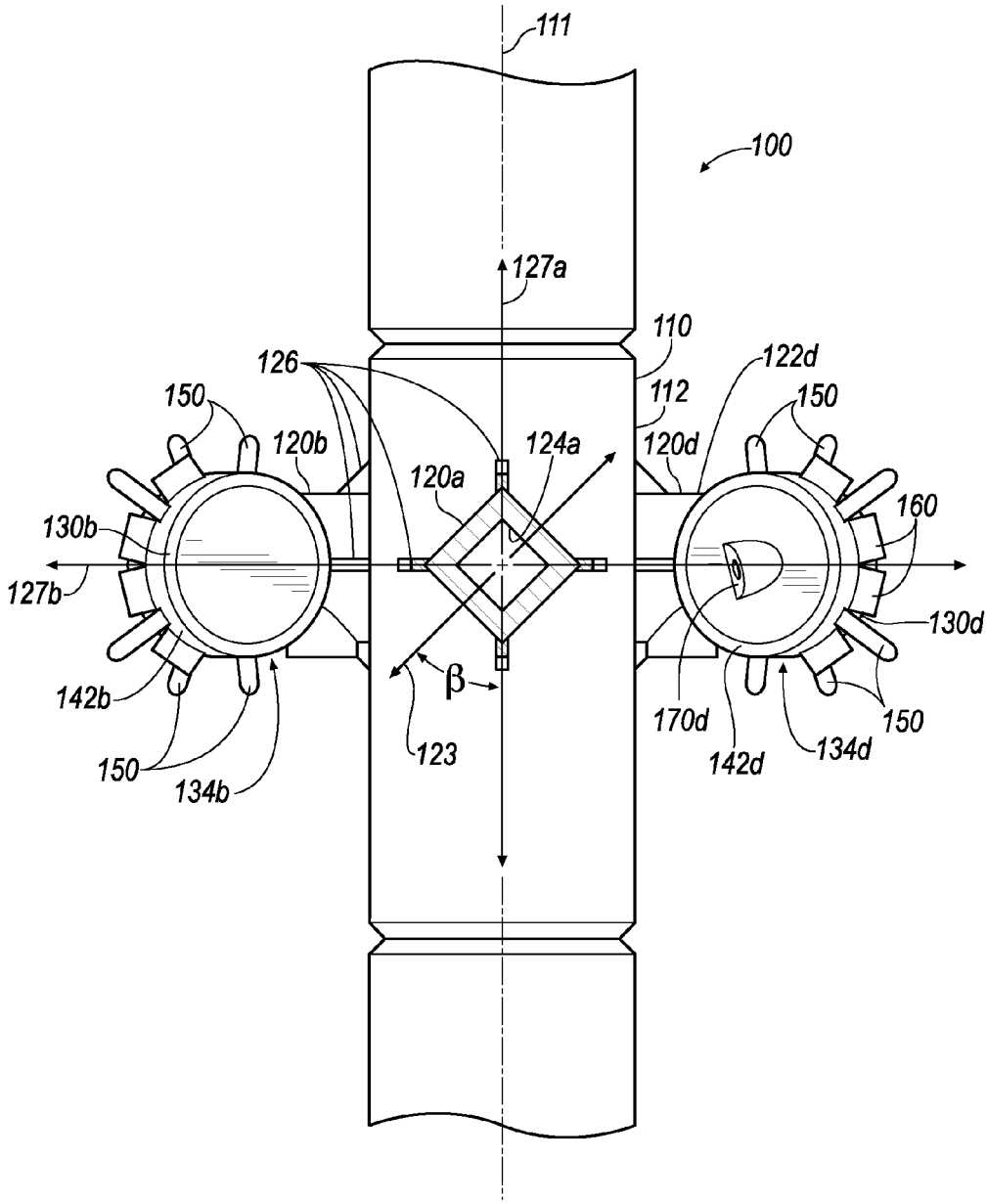
FIG. 7 is a cross-sectional view taken through a plane containing the mandrel axis and the center of two opposed arms and cutting heads of the reamer shown in FIG. 6.
Figure 8:
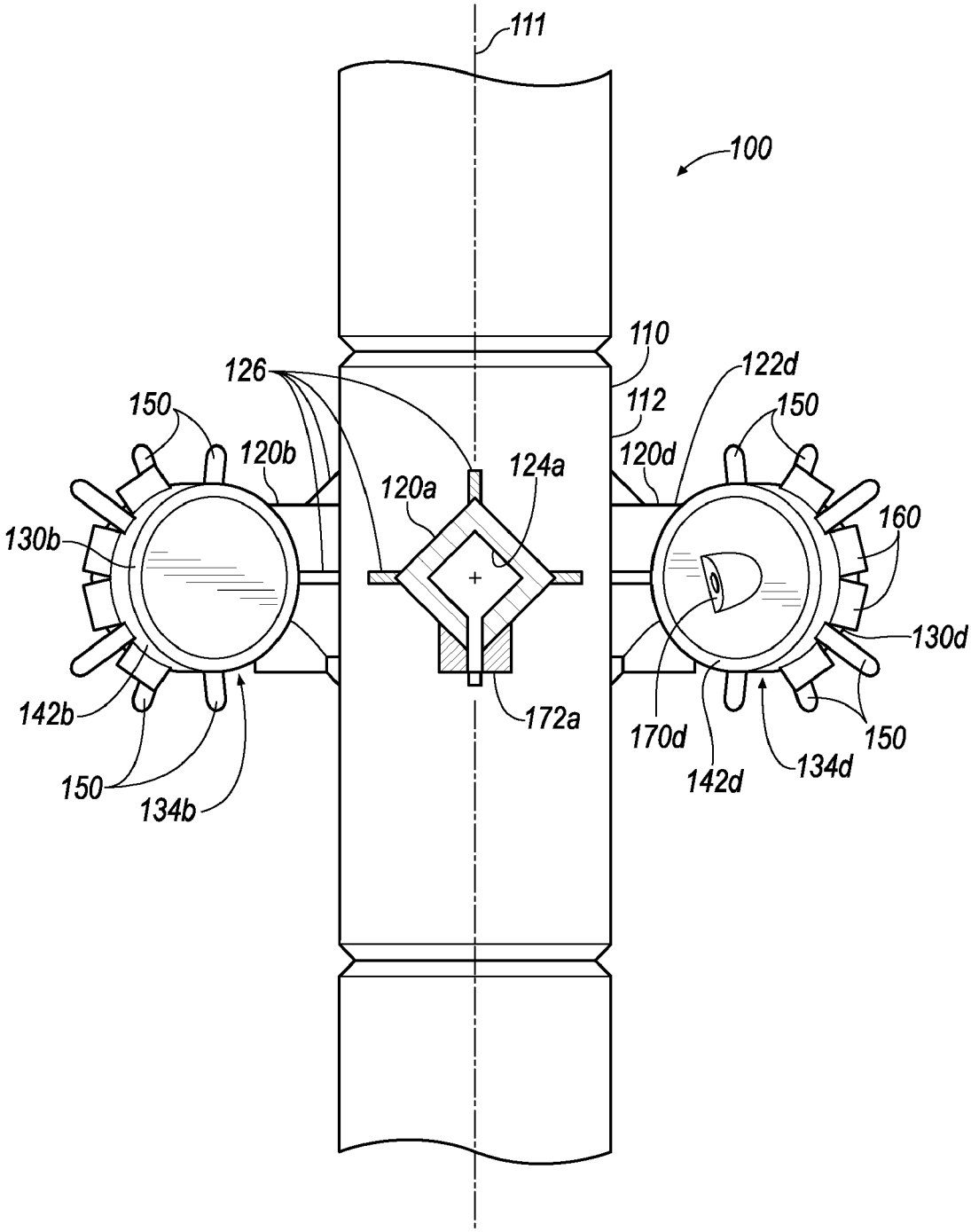
FIG. 8 is a partial cross-sectional view taken along lines 8-8 of the view of the reamer shown in FIG. 6.
Figure 9:
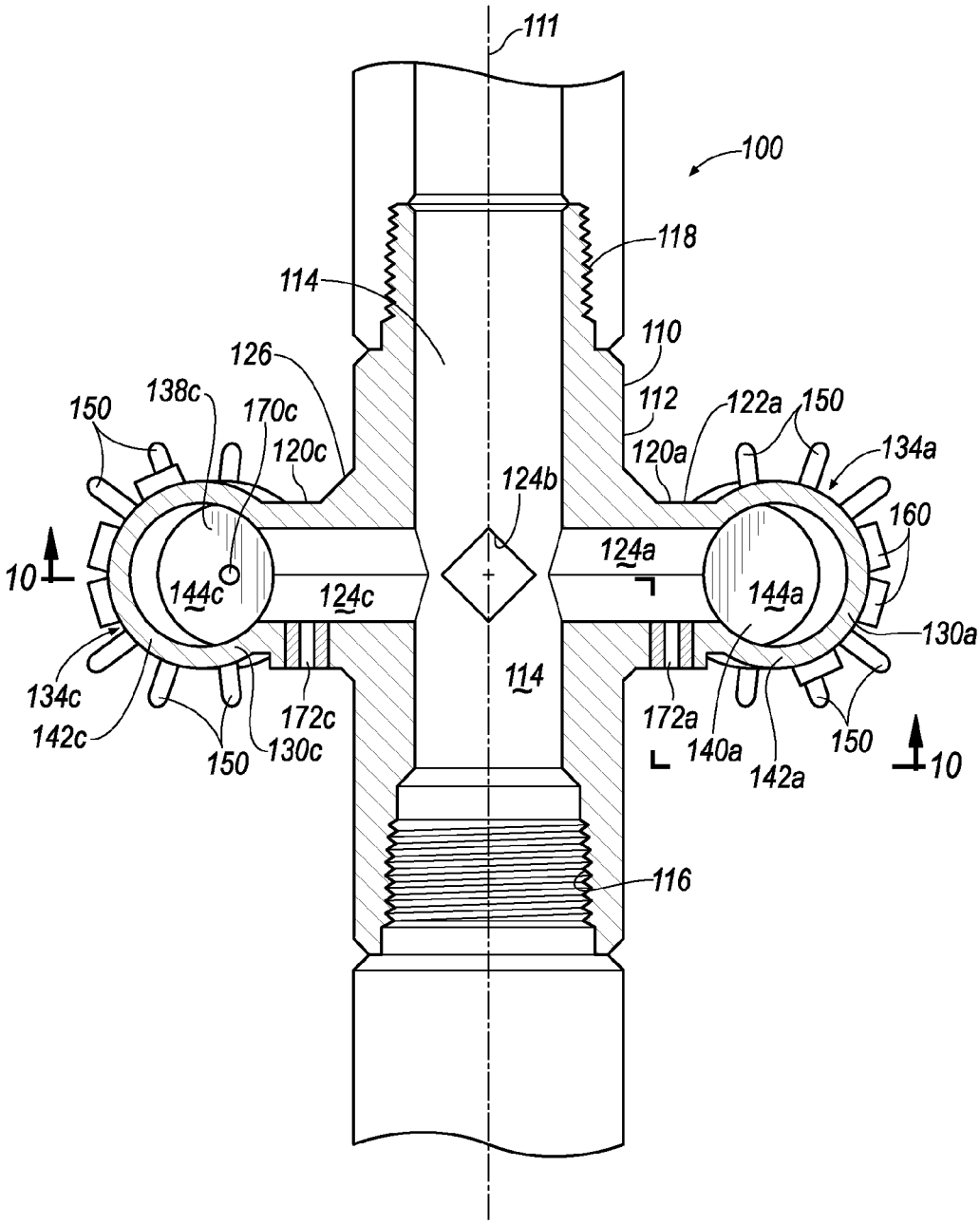
FIG. 9 is a partial cross-sectional view taken along lines 9-9 of the view of the reamer shown in FIG. 7.
Figure 10:
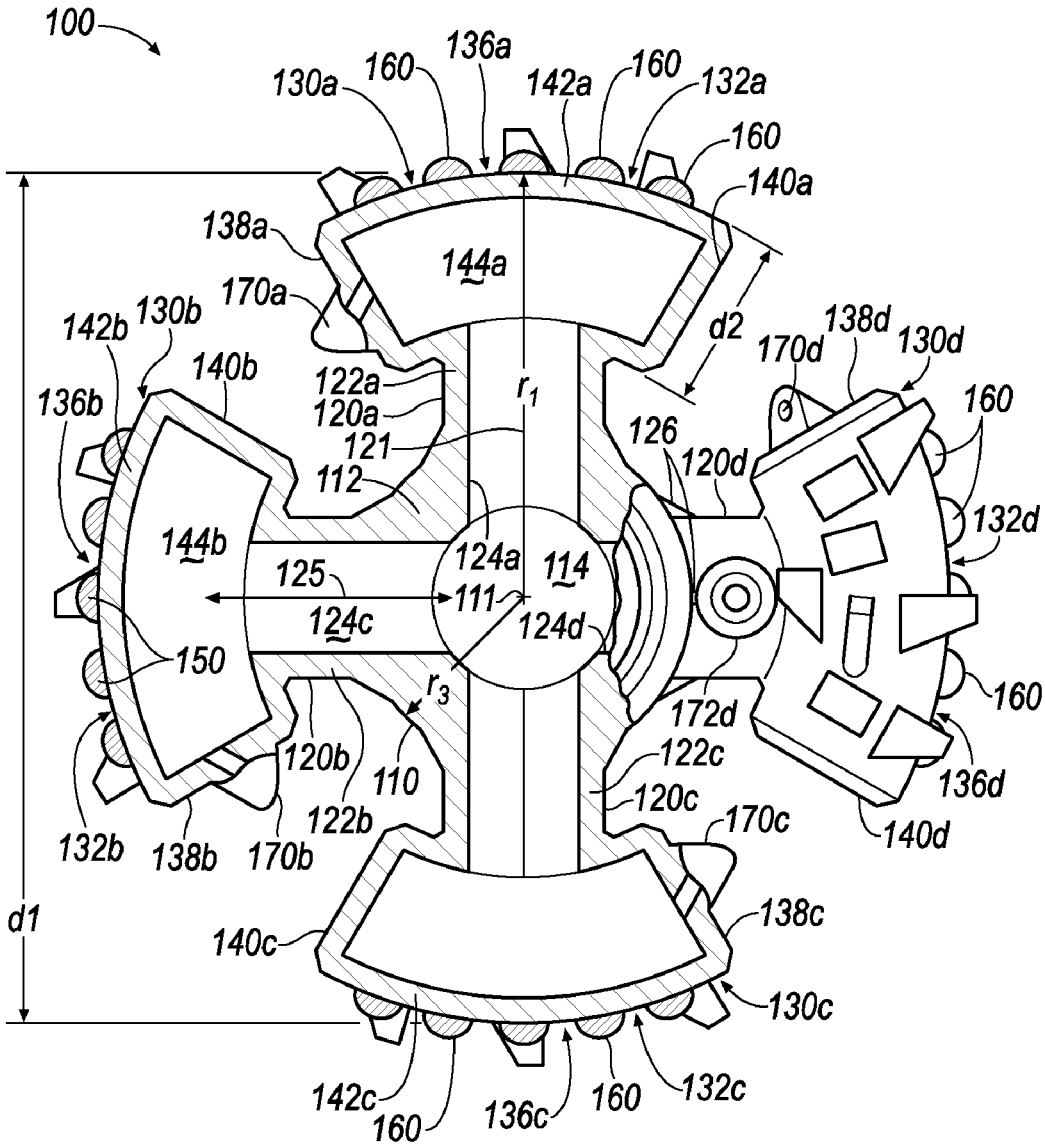
FIG. 10 is a partial cross-sectional view taken along lines 10-10 of the view of the reamer shown in FIG. 9.

Referring to FIG. 7, in some implementations, each arm 120*a-d* is arranged with the transverse axis 123 rotated to an angle β of about 45 degrees with respect to the mandrel axis 111. This arrangement positions a first diagonal cross-sectional axis 127*a* of the arm 120*a-d* parallel with the mandrel axis 111 for relative greater arm strength to sustain bending moments of the arm 120*a-d* created about the mandrel 110 when advancing the reamer 100 in the pilot bore 12. The arrangement also positions a second diagonal cross-sectional axis 127*b* of the arm 120*a-d* perpendicular to the mandrel axis 111 and parallel to a plane of rotation of the arms 120*a-d* for providing relatively greater arm strength to sustain bending moments of the arm 120*a-d* created about the mandrel 110 when rotation the reamer 100 and engaging the cutting heads

130*a-d* against the ground surface, as compared to arranging the arm 120*a-d* with its transverse axis 123 parallel to the mandrel axis 111. For example, in the arrangement shown, relatively greater bending moments created in a plane along one of the cross-sectional axes 127*a*, 127*b*, as may be incurred when moving the reamer forward or backward in the pilot bore 12 or when rotating the reamer about the mandrel axis 111, can be sustained by the arms 120*a-d*, as compared to having the substantially square cross-sectional shaped arms 120*a-d* arranged with each of their transverse axes 123 substantially parallel to the mandrel axis 111.

To provide even greater arm strength to sustain bending moments of the arm 120*a-d* about the mandrel 110, the reamer 100 may include gussets 126 between the arm 120-*a-d* and the mandrel 110 along the first and second diagonal axes 124*a-b* to strength the connection between the arm 120*a-d* and the mandrel 110. The gusset 126 may be a piece of material, such as a metal plate (e.g., substantially triangularly shaped), attached to both the arm 120*a-d* and the mandrel 110. The combination of the oriented square cross-sectional arms 120*a-d* and gussets 126 provide sufficient strength to sustain the bending moments of the arms 120*a-d* about the mandrel 110 without breaking off or deforming under normal operating conditions.

The arms 120 are configured to be sufficiently strong to withstand the forces encountered during horizontal boring. The cutting heads can be arcuately spaced around the mandrel axis 111 to allow movement of debris between the cutting heads 130*a-d*. In some examples, each tubular arm body 122*a-d* has an outer dimension (e.g., diameter, width, height) approximately one-half the outer diameter of the mandrel 110. Moreover, in some examples, each tubular arm body 122 *a-d* can have a similar wall thickness to the tubular body 112 of the mandrel 110.

The cutting heads 130*a-d* are supported by the respective arms 120*a-d*. Each cutting head 130*a-d* has a rounded external surface 132*a-d*, wherein a portion of the rounded external surface 132*a-d* faces radially outward to present a curved profile when viewed from a direction along the mandrel axis 111. In some examples, the curved profile of the rounded external surface 132*a-d* of each cutting head 130*a-d* is of an arc of a circle having a radius from the mandrel axis 111. This arc is defined by a radius of the circle that is equal to or less than the radius of the pilot bore 12 that the reamer 100 is adapted to open, for example, equal to or less than the radius of a 24", 30", 36", 42", 48"-diameter bore, as the case may be. For example, each of the rounded external surfaces 132*a-d* can have a curved profile 134*a-d* in a plane along the mandrel axis 111, as shown in FIG. 4, and each of the rounded external surfaces 132*a-d* may have a curved profile 136*a-d* in a plane perpendicular to the mandrel axis 111, as shown in FIG. 5.

In some implementations, each cutting head 130*a-d* has a forward rotational end 138*a-d* facing the direction of rotation C of the reamer 100 about the mandrel axis 111. Each of cutting head 130*a-d* may have also have a rearward rotational end 140*a-d* facing the opposite direction of rotation C of the reamer 100 about the mandrel axis 111. Each cutting head 130*a-d*, in some examples, has the shape of a fractional segment of a torus. In geometry, a torus (pl. tori) is a surface of revolution generated by revolving a circle in three-dimensional space about an axis coplanar with the circle, which does not touch the circle. A torus has a major radius, that is, the radius of revolution about the axis that is coplanar with the circle, and it has a minor radius, that is, the radius of the circle. The major radius of a torus is the length from the axis to the outermost edge of the circle from the axis of the torus. Another expression of the definition is that a torus is a surface obtained by rotating a circle about a line that lies in its plane, but which has no points in common. Examples of tori include the surfaces of doughnuts and inner tubes. (A solid contained by the surface is known as a toroid.)

In the illustrated reamer 100, which has four cutting heads 130*a-d*, each of the cutting heads 130*a-d* has a one-eighth torus-shaped body 142*a-d*. The one-eighth torus-shaped body 142*a-d* defines a head passageway 144*a-d* in fluid communication with the respective arm passageway 124*a-d* for receiving drilling fluid. If the reamer 100 has three cutting heads, for example, each can be a one-sixth torus-shaped body, or more cutting heads, for example, such as five cutting heads, each can be a one-tenth torus-shaped body. The mandrel axis 111 is also the torus axis, and the torus has a major radius measured from the mandrel axis 111. The torus shape defines a major radius $r_1$ (not shown) and a minor radius $r_2$ (shown in FIG. 5), each of which is one-half the outer diameters $d_1$ of the reamer 100 and $d_2$ of cutting heads 130*a-d*, respectively, both of which are shown in FIG. 5. The shape does not have to be part of a perfect torus, although it can be. The mandrel 110, arms 120*a-d*, and cutting heads 130*a-d* can be rotationally balanced around the mandrel axis 111. In some examples, the minor radius $r_2$ of the torus is less than the difference of the major radius $r_1$ of the torus and the outer radius $r_3$ of the mandrel 110. In additional examples, the torus has a minor radius $r_2$ that is in the range of ½ to 1 times that of the outer radius $r_3$ of the mandrel 110. In some examples, the major radius of the circle of the one-eighth torus-shaped body 142*a-d* of each of the cutting heads 130*a-d* is approximately equal to the outer diameter of the mandrel 110.

Each of the curved external surfaces 132*a-d* of the cutting heads 130*a-d* may include a plurality of cutting teeth 152. The cutting teeth 150 can be in the form of cutting spikes, wedges, an/or blades. Referring to FIGS. 3-10, in some implementations, one or more of the cutting teeth 150 has at least one cutting edge 152 to assist in cutting swaths of rock and soil as the reamer 100 is rotated in the rotational direction C about the mandrel axis 111. Each of the cutting teeth 150 on the rounded external surface 132*a-d* of each cutting head 130*a-d* has at least one cutting edge 152, wherein at least a portion of a length of the cutting edge 152 is oriented to face the direction of rotation C of the reamer 100 around the mandrel axis 111. In some examples, each of the cutting teeth 150 is formed of tungsten carbide.

Referring to FIGS. 11-13, in some implementations, each cutting tooth 150 has a tooth body 154 attached (e.g., at a first weld 155) to the rounded external surface 132*a-d* of a cutting head 130*a-d*. The cutting edge 152 may be part of a replaceable section 156 attached to the tooth body 154 (e.g., at a second weld 157). Moreover, the entire cutting tooth 150 can be replaced, if needed.

Referring back to FIGS. 3-5, each of the curved external surfaces 132*a-d* of the cutting heads 130*a-d* may support a plurality of wear bars 160. Each of the wear bars 160 can have the form of a semi-cylindrical body attached (e.g., welded) on the flat side thereof to one of the external surfaces 132*a-d*. Each of the wear bars 160 can be formed of tungsten carbide. The wear bars 160 assist in grinding rock and soil and preserving the curved external surfaces 132*a-d* of the cutting heads 130*a-d* as the reamer 100 is rotated about mandrel axis 111.

The cutting teeth 150 and wear bars 160 on the curved external surfaces 132*a-d* of the cutting heads 130*a-d* cut and grind dirt and rock to increase the diameter of the pilot bore or to further increase the diameter of a previously-enlarged bore.

In some implementations, the reamer 100 includes one or more fluid ports 170*a-d*, 172*a*, 172*c* in fluid communication with the respective arm passageway 124*a-d* and/or head passageway 144*a-d* of the respective cutting head 130*a-d* for delivering drilling fluid to the region of the reamer 100 (e.g., to lubricate the drilling operation). For example, each of the cutting heads 130*a-d* may have a fluid port 170*a-d* positioned on the forward rotational end 138*a-d* (see e.g., FIG. 5) to deliver drilling fluid in the direction of rotation C of the reamer 100. In additional examples, one or more fluid ports 172*a*, 172*c* can be positioned on one or more of the arms 120*a*, 120*c* (see e.g., FIG. 4) to deliver drilling fluid in the direction of drilling D and/or the direction of rotation C of the reamer 100. The particular arrangement and shape of the fluid ports 170*a-d*, 172*a*, 172*c* can be varied or symmetrical about the reamer 100.

As illustrated in FIGS. 3-5, the cutting teeth 150 can be positioned around the periphery of the curved external surfaces 132*a-d* of the cutting heads 130*a-d*. The separate cutting teeth are arcuately spaced apart and staggered across the curved surfaces, preferably both axially relative to the mandrel axis 111 around the reamer 100. The number and particular arrangement of the cutting teeth 150 and wear bars 160 can vary. More or less cutting teeth 150 can be used as required for a particular application. The number and arrangement of the cutting teeth 150 can provide staggered cutting swaths across the entirety of all the paths of all the curved external surfaces 132*a-d* of the cutting heads 130*a-d*.

The reamer 100 has an advantage of not requiring any moving parts as it is rotated in the difficult environment of underground boring. Moreover, the arms 120*a-d* and corresponding arcuately spaced cutting heads 130*a-d* allow the movement of debris therebetween for relatively more efficient reaming. Unlike monolithic reamers having continuous outer diameters which cannot be easily altered in size, the arms 120*a-d* of the reamer 100 can be altered in length and number about the mandrel 110 to accommodate various reaming sizes (e.g., to create reamed bores 13 of a particular size).

Other details and features on horizontal pipeline boring apparatuses and reamers, which may combinable with those described herein, can be found in U.S. Pat. No. 5,314,267; U.S. Pat. No. 5,979,573; U.S. Pat. No. 5,979,574; the contents of which are hereby incorporated by reference in their entireties A number of implementations have been described. Nevertheless, it will be understood that various modifications may be made without departing from the spirit and scope of the disclosure. Accordingly, other implementations are within the scope of the following claims.

What is claimed is:

1. A reamer for underground boring, the reamer comprising:

a mandrel defining a mandrel axis;

arms extending radially from the mandrel, each arm having a proximal end and a distal end;

a cutting head disposed on the distal end of each arm; and cutting teeth disposed on each cutting head;

wherein the cutting heads are arcuately spaced about the central mandrel to allow the movement of debris axially along the central mandrel; and wherein at least one of the arms defines a substantially square cross-sectional shape.

2. The reamer of claim 1, wherein the at least one arm having a substantially square cross-sectional shape defines a longitudinal axis coincident with a radial axis of the mandrel.

3. The reamer of claim 1, wherein opposite corners of the substantially square cross-sectional arm shape are arranged in a line substantially parallel to the mandrel axis.

4. The reamer of claim 1, further comprising at least one gusset between each arm and the mandrel.

5. The reamer of claim 1, wherein each arm defines a passageway along a length of the arm.

6. The reamer of claim 1, further comprising wear bars disposed on each cutting head.

7. The reamer of claim 6, wherein the wear bars each define a half-circular cross-shape.

8. The reamer of claim 6, wherein a collection of wear bars are disposed along a radial distal portion of each cutting head.

9. The reamer of claim 8, wherein cutting teeth are disposed on opposite sides of the collection of wear bars along the radial distal portion of each cutting head.

10. The reamer of claim 1, wherein the mandrel defines a mandrel passageway in fluid communication with an arm passageway defined by at least one of the arms, and at least one port defined by the corresponding cutting head of the at least one arm for receiving a flow of drilling fluid therethrough.

11. The reamer of claim 10, wherein the at least one port is arranged to deliver a flow of drilling fluid substantially in a direction of drilling.

12. The reamer of claim 10, wherein the at least one port is arranged to deliver a flow of drilling fluid substantially in a direction of rotation around the mandrel axis.

13. The reamer of claim 1, wherein the mandrel has first and second axial ends, at least one of the axial ends adapted for connection to a drill pipe.

14. The reamer of claim 1, wherein a surface of at least one cutting head defines an arcuate section of a torus.

15. The reamer of claim 14, wherein the cutting teeth of the at least one cutting head are disposed on the surface defining an arcuate section of a torus.

16. The reamer of claim 15, further comprising wear bars disposed on the at least one cutting head.

17. The reamer of claim 15, wherein the cutting teeth each have at least one cutting edge arranged to face a direction of rotation around the mandrel axis.

18. The reamer of claim 1, wherein the intersection of the cutting heads with the respective distal ends of the tubular arms defines a shoulder overhanging the central mandrel.

* * * * *